United States Patent [19]

Myska

[11] Patent Number: 5,065,619

[45] Date of Patent: Nov. 19, 1991

[54] METHOD FOR TESTING A CASED HOLE FORMATION

[75] Inventor: Glen A. Myska, Bakersfield, Calif.

[73] Assignee: Halliburton Logging Services, Inc., Houston, Tex.

[21] Appl. No.: 477,391

[22] Filed: Feb. 9, 1990

[51] Int. Cl.[5] ..... E21B 49/00

[52] U.S. Cl. ..... 73/152; 73/714; 166/250

[58] Field of Search ..... 73/152, 155, 714; 166/250, 252

[56] References Cited

U.S. PATENT DOCUMENTS 3,813,936 6/1974 Urbanosky et al. ..... 73/155

4,339,948 7/1982 Hallmark ..... 73/155

*Primary Examiner*—Hezron E. Williams

*Assistant Examiner*—Craig Miller

*Attorney, Agent, or Firm*—William J. Beard

[57] ABSTRACT

A method for fluid pressure testing of a formation behind casing is set forth. A formation testing tool is lowered into the well to a specified depth opposite a formation of interest behind a casing. A test probe is extended and a perforation is formed from the test probe into the formation to obtain fluid communication with the formation. Utilizing a storage container in the testing tool, fluid is pumped from the formation into the test tool, or from the test tool into the formation and formation pressures are measured at selected intervals.

11 Claims, 1 Drawing Sheet

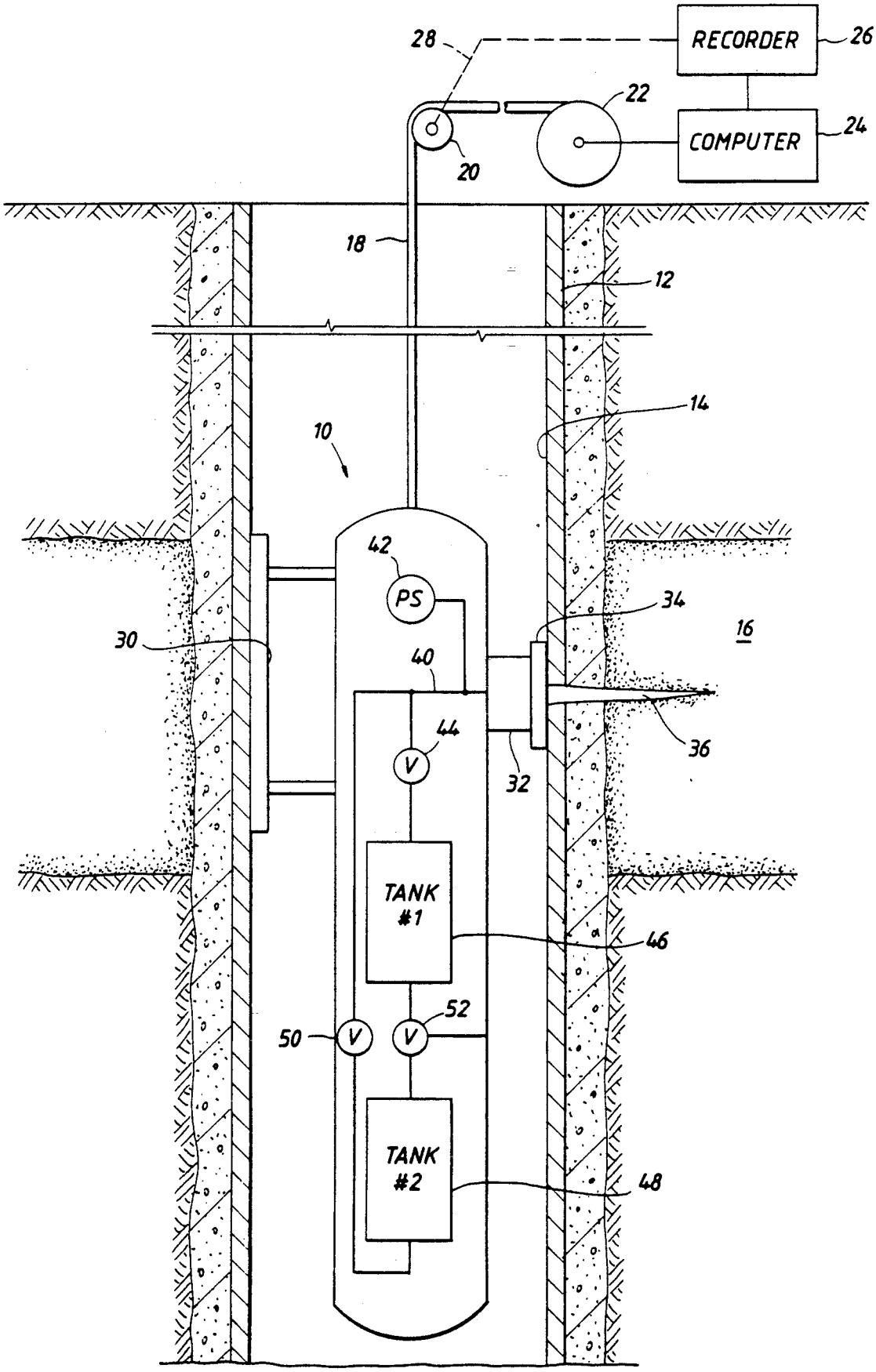
RECORDER
26
28
22
COMPUTER
24
20
18
12
14
10
42
PS
34
16
30
40
44
V
36
32
TANK #1
46
52
50
V
V
TANK #2
48

METHOD FOR TESTING A CASED HOLE FORMATION

BACKGROUND OF THE DISCLOSURE

This disclosure is directed to a formation testing procedure which measures formation pressures over a period of time and particularly formation pressures for formations behind a cased well borehole. After a well has been drilled and it has been determined that some formation of interest will produce in quantity, the hole is typically cased and perforations are formed through the casing into one or more formations to produce oil or gas, sometimes with a mixture of water or sand. Production continues for an interval after which formation pressures typically start to drop. Often, a formation is capable of producing by formation pressure drive. As formation pressures drop, the formation may be produced by placing various types of pumping devices in the borehole. Ultimately, formation pressure will drop and subsequent remedial or secondary completion techniques are used. An important factor is the formation pressure and particularly formation pressure change over a period of time and especially after the formation has been partially depleted. While one formation may be depleted completely, another formation isolated from the well by the casing can be completed long after the casing has been installed. In these and other circumstances, it is appropriate to go into the well with a formation pressure test tool, sometimes known as a formation tester, and perform subsequent tests of the formation to obtain data regarding either the produced formation or other formations.

An important data is the rate of formation pressure change over a period of time. Typically, a formation tester is connected with the formation of interest and time decay pressure measurements are taken. This involves forming a small perforation through the casing into the formation. For this purpose, the formation tester normally includes an extendable pressure pad which is mounted on an extendable test probe. The pressure pad is brought firmly to contact the casing and contours against the casing to prevent leakage around the pressure seal encircling the tip of the test probe. It is forced against the casing while a backup shoe on the opposite side of the formation tester is extended to hold the formation tester in location. A small shaped charge is detonated to form a small hole (perhaps one centimeter in diameter) through the casing and into the formation.

The present disclosure sets forth methods and an apparatus which carries out the foregoing tests and several additional tests as will be described. Consider, as an example, one advantageous test. Assume a field having several wells, and further assume that a particular well is to be used as an injection well to practice secondary recovery techniques featuring injection of one fluid into one well with the hope that enhanced recovery at nearby adjacent wells will be observed. In the past, an assumption has been made, in the absence of contrary data, that fluid flow from the formation occurs at the same rate at which fluid can flow back into the formation. Assume that a particular formation produces a specified volume of fluid in a twenty-four hour period. Assume further that this flow for one day produces a formation pressure drop of 3 psi. It has been assumed that injection back into that particular formation of the same fluid volume over one day will in similar fashion raise the formation pressure by about 3 psi. In general, the formation has been treated as a type of bidirectional conduit having a known or measurable resistance to fluid flow. This is not necessarily true, and it appears to be more untrue especially for unconsolidated formations and diatomite formations. Assume that the perforation through the casing opens into an unconsolidated formation. If flow is from the formation into the cased well, production of formation sand will occur. This permits some shifting and will ultimately change formation pressure while also locally changing formation porosity. By contrast, if the same quantity of fluid is injected back into the formation without the sand that was previously produced, there is no precise relationship which states what the formation pressure should be at the completion of reinjection of the same quantity of fluid. The formation does not permit fluid flow bidirectionally. Accordingly, if several wells in a common field are unitized for secondary recovery, and certain of the wells are converted into injection wells while the remainder of the wells are recovery wells, the assumption that flow is easily established from the injection well to the nearby recovery wells is erroneous.

In summary, the present disclosure sets forth a method and apparatus which enables formations to be pressure tested in a different fashion and in particularly in a cased borehole.

BRIEF DESCRIPTION OF THE DRAWINGS

So that the mnanner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

The single drawings shows a formation tester supported in a cased well borehole for conducting certain pressure tests in accordance with the teachings of the present disclosure where the tests are performed through the casing into a selected formation.

DETAILED DESCRIPTION OF THE PREFERRED EMBODIMENT

Attention is directed to the only drawing where a formation tester 10 supported in a well 12 which is lined with a casing 14 normally cemented in place. The casing goes to a specified depth. A formation 16 is on the outside of the casing and is the formation of interest to be tested. It can be any formation which is covered over or isolated by the casing 12. Moreover, the formation 16 can be a formation which has been produced toward depletion or a formation which has never been produced. In any event, formation 16 is the formation which will be tested utilizing the methods and apparatus of the present disclosure in an advantageous fashion.

The formation tester 10 can be the Model SFT-3 of Halliburton Logging Services, Inc. This type of formation tester can be used in the procedures to be described below. The formation tester is lowered into the well borehole on a logging cable 18 which includes one or more electrical conductors therein and a steel cable to support the weight of the tool 10. The logging cable 18 extends to the surface and passes over a sheave 20 and is spooled on a reel or drum 22. The signals provided along the cable 18 are output to a CPU 24. In turn, that connects with a recorder 26 which records the data as a function of time. Depth measurements are also obtained by means of an electrical or mechanical depth measuring apparatus 28 which provides a depth indication signal from cable movement.

The tool 10 is typically constructed with a backup shoe 30 which extends on one side of the tool and jams against the adjacent sidewall, this being true in cased and uncased wells. It further includes a test probe 32 which is hydraulically extended in a known fashion. The member 32 extends radially outwardly opposite the backup shoe 30. It includes a surrounding seal ring 34 which forms a seal conforming to the shape of the casing 14. It is known in the art to position a small shaped charge centered within the ring 34. The shaped charge is detonated to form a relatively small perforation 36 which extends through the casing and into the formation 16. The perforation is typically in the range of about one or two centimeters in diameter at the casing and tapers so that it has a total length of perhaps ten to fifteen centimeters into typical formations. A fluid flow passage is created by the perforation 36 and connects to the test probe 32 and into a fluid flow line 40 within the tool 10. The flow line so connects with a pressure sensor 42 so that pressure in the line can be measured. Measurements of pressure at this location reflect the pressure of the formation in fluid communication with the sensor 42.

The line 40 has several branches. A first branch extends through a valve 44 into the first tank 46. More will be noted regarding this. In addition, the line 40 also connects with a second tank 48. This connection is through a valve 50. Fluid can be introduced from another source to be described through a fluid flow line which is controlled by the valve 52.

Typically, the tanks that are included in the tool 10 are described as a pretest sample holder which is normally quite small and a sample tank which is much larger. It is not uncommon to have pretest tanks as small as twenty-five or fifty cubic centimeters capacity. In similar fashion, the second tank is much larger but operates in substantially the same fashion. It can hold several liters, perhaps ten liters of fluid. In this particular instance, the tank 48 is a typical sample container of about ten liters or so. It is, however, connected so that it is able to store liquid for injection into the well to point out and take advantage of one of the important features of the present apparatus. This will be more apparent from a description of the test procedure and routine set forth below.

PRETEST FLUID REMOVAL AND REINJECTION

The tool 10 is positioned in the well 12 and is lowered to a position even with the formation 16. In the initial condition, the tank 46 is empty. The backup shoe 30 is extended on one side while the test probe 32 is extended on the opposite side and brought into sealing contact with the surrounding casing. By means of a timed electrical current supplied to a small shaped charge, the perforation 36 is then formed. Once a fluid flow passage is established into the tool 10, fluid is removed through the line 40 and the valve 44 is opened to fill the tank 46. This is typically a pretest sample or specimen. Before the tank 46 is filled, formation pressure through the perforation 36 is measured by the sensor 42. This provides a first pressure reading. After the pretest sample is removed and the tank 46 is filled to the designated volume, another pressure reading is obtained from the formation. This is obtained after closing the valve 44. This may or may not show a pressure drop, but it is the pressure obtained after removal of the pretest sample in the tank 46. Formation pressure is read several times over an interval to assure that it stabilizes at some final pressure level. If the sample is relatively small, ordinarily it is not necessary to wait for a long time for pressure to stabilize. In any event, over a specified and measured interval, the formation pressure may show some evidence of decline as a result of fluid removal.

After formation pressure is stabilized on removal of the pretest sample, the present invention contemplates testing the ability of formation 16 to receive that same quantity of fluid back into the formation. The sample which was removed is forced back into the formation through the perforation 36. Formation pressure is then monitored for an extended interval to assure that the pressure will stabilize.

ANOTHER TEST PROCEDURE INVOLVING FORMATION STIMULATION

In another procedure, assume that the tool 10 is lowered into the well and positioned as shown in the drawing and that the perforation 36 is formed. Assume further that no pretest sample is removed. Assumed further that the tool 10 was loaded by filling the tank 48 with a formation treatment fluid. This can be, by way of example and not limitation, a strong acid, strong base, liquid proppant or other treatment fluid. For instance, some formations are treated by acidizing which basically involve pumping quantities of liquid acid into the borehole to attack the particles which make up the formation 16. The tank 48 can be filled when the tool 10 is at the surface. It is filled with a secondary recovery fluid. Typical fluids include acid. Other secondary recovery fluids are permitted. The tank 48 is first filled at the surface and the tool is run into the well. After the perforation is made, the flow line 40 is opened between the tank 48 and the perforation 36. This is accomplished by first opening the valve 52 and secondly opening the valve 50. Typically the down hole pressure in the well at the depth of the tool exceeds the formation pressure. As an example, the pressure in the well at this depth might be 1,000 psi while the pressure in the formation is 500 psi. This provides sufficient fluid pressure drive admitted to the tank 48 to force the fracture fluid out of the tank 48, through the valve 50 and into the formation 16 through the perforation 36. This flow introduces the secondary recovery fluid in the formation.

The flow is continued until the tank 48 is empty. If well pressure is insufficient, the tank 48 can be pressured by placing a gas head in the tank at a very high pressure, or filling a small tank in the tool 10 with gas at an elevated pressure and connecting that tank to the tank 48. In either case, the fluid drive is delivered to the tank 48 to force the well treating fluid out of the tank. Typically, the tank 48 is filled with a liquid such as acid. Typically, the pressure drive fluid is nitrogen or other inert gases. There may be tests, however, which require the use of the injection fluids from the tank 48. Whatever the circumstance, a high pressure source is made available either from another tank or from the borehole which serves as a fluid pressure drive introduced into the tank 48 to thereby empty the tank and force the contents of the tank into the formation 16.

DATA TAKING SEQUENCE

In a typical operation, data is obtained from the formation 16 by the pressure sensor 42. The data is obtained by transmitting the readings of the sensor 42 through a suitable encoding or telemetry system to the surface, data formatting at the CPU 24 and recording as a function of depth at the recorder 26. Assuming that the logging tool 10 has been lowered to the requisite depth, the first step is to provide the pressure before and after the perforation 36 is formed. As soon as it has been formed, the pressure sensor 42 measure a baseline or steady state condition for formation pressure. Then, typically the tank 46 will be filled by drawing fluid from the formation. When the tank is filled the pressure is again recorded. Pressure is recorded as a function of time as the tank is filled. Time is permitted to pass until the pressure stabilizes if there is a change. The foregoing can be done using a larger tank or smaller tank as required. In any event, these pressure levels are measured to provide appropriate baseline measurements.

After the formation pressure stabilizes, the next sequence may involve restoring the pretest sample in the tank 46 to the formation. The tank is pumped to remove the fluid and the stored fluid is delivered to the formation. Formation pressure again is monitored before and after restoration of the removed fluid. In the latter sequence, it may be necessary to use a stored pressure fluid to provide the drive to clear the tank. As mentioned, well pressure can be used assuming it is greater than the formation pressure.

From the foregoing data, pressure fall off test data will describe the formation. It is not always accurate to assume flow in the opposite direction would provide the same data. Formation pressure is thus measured before and after injection of fluid back into the formation. The same is true where the formation fluid injected into the formation is a secondary recovery fluid such as acid, liquid supporting proppant material and the like.

To summarize to this juncture, the present approach provides measurements of the formation especially when fluid is reinjected into the formation, or when secondary recovery fluid is injected into the formation.

In the latter instance, the formation may not perform in a linear fashion, that is, providing the same rate for flow out of the formation as well as into the formation. This is particularly true for unconsolidated formations. In this instance, the flow rate out of the formation can be quite high because the loss of fluid tends to shift the particles, thereby creating larger fluid flow voids in the formation. When fluid flows from the testing tool back into the formation, the rate at which that fluid is accepted is relatively lower than the rate at which the formation does produce. Flow rate is a function of reservoir condition, i.e., pressure differential across the perforation, prior formation production history, fluid rheology relative to the formation, porosity, formation compressibility, permeability, and in the case of diatomite formations, wettable surface area of the rock matrix. In an exemplary diatomite formation, it is characterized by relatively high porosity and low permeability. Flow rates are nil until the well is fractured. Yet the diatomite will imbibe fluid thus yielding a non linear pressure drop across the perforations based on flow direction.

The foregoing is directed to the preferred embodiment of the present invention which has been described in the appended claims.

What is claimed is:

1. A method of testing a formation comprising the steps of:

(a) lowering a formation testing tool having a test probe which extends therefrom to a selected formation behind a casing in a well borehole;

(b) connecting the test probe into a selected formation behind the casing;

(c) connecting the test probe through a valve with a fluid receiving chamber;

(d) selectively operating the valve to fill a fluid receiving chamber with fluid from the formation;

(e) pumping a fluid volume from the testing tool into the formation through the test probe, wherein a fluid receiving chamber is the source of fluid for pumping into the formation; and (f) measuring information fluid pressure at selected times to determine formation fluid pressure.

2. The method of claim 1 including the step of forming a perforation through the casing using a shaped charge supported by the testing tool and connecting the test probe with such perforation.

3. The method of claim 1 including the step of connecting a pressure sensor to a flow line connected with the test probe and measuring formation pressure with that sensor to obtain the undisturbed formation pressure, formation pressure after removal of fluid, and formation pressure after pumping fluid from the testing tool into the formation.

4. The method of claim 1 including the step of prefilling a liquid chamber in the testing tool prior to lowering the testing tool to the formation of interest; and thereafter emptying that chamber by forcing the fluid therein from the testing tool through the test probe into the formation.

5. The method of claim 4 wherein the prefilling step places treatment fluid in the chamber.

6. The method of claim 1 wherein the step of measuring formation fluid pressure is extended over a period of time to enable formation fluid pressure to stabilize after disturbance of the formation.

7. The method of claim 1 including the step of continuously monitoring formation pressure for an interval of time.

8. The method of claim 1 including the step of prefilling a liquid chamber in the testing tool, and wherein the step of pumping a fluid volume from the testing tool removes the prefilled liquid, and thereafter, for a specific interval, measuring formation fluid pressure.

9. The method of claim 8 including the step of prefilling with a treatment fluid.

10. The method of claim 9 including the step of flowing the formation to clear debris from the formation perforation prior to pumping fluid into the formation.

11. The method of claim 10 including the step of measuring the time required for formation pressure to return to the original formation pressure after pumping fluid into the formation.

* * * * *